US007278931B2

(12) United States Patent
Manami et al.

(10) Patent No.: US 7,278,931 B2
(45) Date of Patent: Oct. 9, 2007

(54) GOLF BALL

(75) Inventors: Toshihiko Manami, Chichibu (JP); Eiji Takehana, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 11/334,369

(22) Filed: Jan. 19, 2006

(65) Prior Publication Data

US 2007/0167254 A1 Jul. 19, 2007

(51) Int. Cl.
*A63B 37/12* (2006.01)

(52) U.S. Cl. ..... 473/378

(58) Field of Classification Search ..... 473/378, 473/351

See application file for complete search history.

(56) References Cited

U.S. PATENT DOCUMENTS 5,403,010 A * 4/1995 Yabuki et al. ..... 473/372
6,824,479 B2 11/2004 Isogawa et al.
6,949,595 B2 * 9/2005 Morgan et al. ..... 524/102
2006/0276264 A1 * 12/2006 Kennedy et al. ..... 473/371

FOREIGN PATENT DOCUMENTS

JP 2001-087423 A 4/2001
JP 2004-166719 A 6/2004

* cited by examiner

*Primary Examiner*—Raeann Trimiew
(74) *Attorney, Agent, or Firm*—Sughrue Mion, PLLC

(57) ABSTRACT

In a golf ball having a core or a sphere composed of a core enclosed by a cover layer and having also an outermost cover layer which covers a surface of the core or a surface of the sphere, the outermost cover layer is composed primarily of at least one thermoplastic resin or thermoset resin, which resin contains an inorganic composite material prepared by coating glass flakes with a metal or metal oxide. This arrangement provides a highly fashionable golf ball endowed with aesthetic characteristics that are novel and have a visual impact on the golfer.

8 Claims, No Drawings

GOLF BALL

BACKGROUND OF THE INVENTION

The present invention relates to a golf ball composed of a core and one or more cover layer. More specifically, the invention relates to a golf ball with a distinctive appearance that has a visual impact on the golfer.

Most solid golf balls have a surface color which is typically white. However, manufacturers have been placing greater emphasis lately on consumer individuality and fashionability by producing different types of colored golf balls and golf balls containing a variety of pigments.

In such solid golf balls, a cover layer which covers the surface of the solid core, particularly an outermost cover layer situated on the outermost side of the cover layer, contains various color pigments, aluminum flakes and pearlescent pigments, thus imparting color or brightness to the surface of the ball. The purpose, of course, is to supply golfers with balls having this type of distinctive and aesthetically pleasing appearance.

An example of such a golf ball is the solid golf ball described in JP-A 2001-87423.

However, in the foregoing prior art, when a cover material containing aluminum flake pigment or pearlescent pigment is injection molded, weld lines generally arise in the direction of flow by the base resin. Such weld lines change the orientation of the pigment. This, together with the large aspect ratio of the pigment, alters the manner in which the pigment is perceived, compromising the uniformity of the ball's appearance.

JP-A 2004-166719 (and corresponding U.S. Pat. No. 6,824,479) disclose, with regard to marks such as lettering or a play number formed on the surface of a golf ball, the formation over the marks and their immediate vicinity of a clear coat which contains a luster material composed of glass flakes coated on the surface with a metal oxide. However, because this prior-art invention imparts brightness only to the area of the marks and does not provide the entire surface of the ball with a distinctive appearance, the ball has only a modest visual impact (novelty).

SUMMARY OF THE INVENTION

It is therefore an object of the present invention to provide a highly fashionable golf ball that has a distinctive appearance with a visual impact on the golfer.

As a result of extensive investigations, we looked at the outermost cover layer which covers either the surface of a golf ball core or the surface of a sphere composed of a golf ball core enclosed by a cover layer, and selected various types of pigments for incorporation in the base resin used to form the outermost cover layer. From this, we discovered that when a predetermined amount of an inorganic composite material prepared by coating glass flakes with a metal or metal oxide is included instead of an aluminum flake pigment or a pearlescent pigment in the base resin and the resulting cover material is injection molded, the formation of weld lines after injection molding can be minimized or prevented, in addition to which brightness can be uniformly conferred to the surface of the ball, giving the ball an aesthetically pleasing appearance that has a visual impact.

That is, because the cover has a certain thickness, by including an inorganic composite material in the cover, the inorganic composite material becomes three-dimensionally and uniformly distributed within the cover. Due to the influence of this three-dimensional distribution, a ball appearance which is novel and has a visual impact can be achieved.

We have also found that, in a golf ball obtained by coloring blue or pink, for example, the core surface or an inner layer located to the inside of the outermost cover layer and forming thereon an outermost cover layer from a composition prepared by blending a clear material as the resin base with the above-described inorganic composite material, synergistic effects between the color fashionability of the core surface or the inner layer located to the inside of the outermost cover layer and the three-dimensional distribution of the inorganic composite material within the outermost cover layer can serve to further enhance the distinctiveness and visual impact of the ball's appearance.

Accordingly, the invention provides the following golf ball.

[1] A golf ball having a core or a sphere composed of a core enclosed by a cover layer, and an outermost cover layer which covers a surface of the core or a surface of the sphere, wherein the outermost cover layer is composed primarily of at least one thermoplastic resin or thermoset resin, which resin contains an inorganic composite material prepared by coating glass flakes with a metal or metal oxide.

[2] The golf ball of [1], wherein the inorganic composite material is included in an amount of 0.01 to 5 parts by weight per 100 parts by weight of the resin.

[3] The golf ball of [1], wherein the outermost cover layer is clear or translucent.

[4] The golf ball of [1], wherein the outermost cover layer has a thickness of at least 1.0 mm but not more than 2.5 mm.

[5] The golf ball of [1], wherein the outermost cover layer has a Shore D hardness of at least 45 but not more than 65.

[6] The golf ball of [1], wherein the core has a deflection, when subjected to a load of 1275 N (130 kgf) from an initial load of 98 N (10 kgf), of from 2.5 to 6.0 mm.

[7] The golf ball of [1], wherein the surface of the core, or the surface of the sphere composed of a core enclosed by a cover layer, is colored.

DETAILED DESCRIPTION OF THE INVENTION

The invention is described more fully below. The golf ball of the invention has a core and a cover composed of one or more layer which encloses the core. Any of various types of cores, including solid cores and thread-wound cores, may be used as the core in the inventive golf ball.

When the core is a solid core, it may be formed using a known rubber composition. The base rubber in the composition is exemplified by polybutadiene. In particular, it is recommended that the base rubber be composed primarily of cis-1,4-polybutadiene having a cis structure content of at least 40%. The base rubber may also contain, together with the foregoing polybutadiene, other types of rubber, such as natural rubber, polyisoprene rubber or styrene-butadiene rubber.

The rubber composition may include, as a co-crosslinking agent, the metal salt (e.g., zinc salt, magnesium salt, calcium salt) of an unsaturated fatty acid (e.g., methacrylic acid, acrylic acid), or an ester compound such as trimethylolpropane trimethacrylate. For a high resilience, the use of zinc acrylate is especially preferred. Such a co-crosslinking agent may be included in an amount of generally at least 10 parts by weight, and preferably at least 15 parts by weight, but not more than 50 parts by weight, and preferably not more than 40 parts by weight, per 100 parts by weight of the base rubber.

The rubber composition may include an organic peroxide. Illustrative examples include 1,1-bis(t-butylperoxy-3,3,5-trimethylcyclohexane), dicumyl peroxide, di(t-butylperoxy)-m-diisopropylbenzene and 2,5-dimethyl-2,5-di-t-butylperoxyhexane. Examples of commercially available products include Percumyl D and Perhexa 3M-40 (both produced by NOF Corporation). The amount of organic peroxide included per 100 parts by weight of the base rubber is generally at least 0.1 part by weight, and preferably at least 0.5 part by weight, but not more than 5 parts by weight, and preferably not more than 2 parts by weight.

If necessary, the rubber composition may include also various types of additives. Examples of such additives include sulfur, antioxidants, zinc oxide, barium sulfate, organosulfur compounds such as the zinc salt of pentachlorothiophenol, and zinc stearate. The amounts in which these additives are included may be suitably adjusted according to the intended purpose, and are not subject to any particular limitation.

The core has a diameter of preferably at least 32.0 mm, and more preferably at least 33.0 mm, but preferably not more than 40.5 mm, and more preferably not more than 39.5 mm.

The core has a deflection (deformation), when subjected to a load of 1275 N (130 kgf) from an initial load of 98 N (10 kgf), of 2.5 to 6.0 mm, preferably 3.5 to 5.0 mm, and more preferably 3.8 to 4.7 mm. If the deflection is too small, the golf ball may have a hard feel when hit with a driver, in addition to which the period of contact between the club and the ball may be so short as to compromise the controllability. On the other hand, if the deflection is too large, the ball may have an excessively soft feel when hit with a driver and a poor durability to cracking on repeated impact.

The surface of the core has a Shore D hardness which, although not subject to any particular limitation, is generally from 28 to 62, preferably from 36 to 51, and more preferably from 39 to 48. The center of the core has a Shore D hardness of generally from 28 to 43, preferably from 32 to 39, and more preferably from 34 to 37. If these Shore D hardness values are too large, the ball may have too hard a feel when hit, and the period of contact between the club and the ball may be so short as to compromise the controllability. Conversely, if these Shore D hardness values are too small, the feel of the ball when hit with a driver tends to be too soft and the ball may have a poor durability to cracking on repeated impact.

The core may be produced by a known method. For example, to obtain a solid core from the core-forming rubber composition, preferred use can be made of a process in which the composition is masticated using an ordinary mixing apparatus (e.g., Banbury mixer, kneader, or roll mill), and the resulting compound is compression molded in a core mold. If the core is a thread-wound core, use can be made of one that is known to the art. The thread-wound core may be obtained by a commonly used method.

In the golf ball of the invention, to further enhance color variation and fashionability, it is desirable for the surface of the core or the surface of the sphere composed of a core enclosed by the subsequently described cover layer to be colored. That is, various color pigments may be added to the core-forming rubber composition or the synthetic resin material in the cover layer which directly encloses the core. Known general-purpose pigments may be used as such color pigments. For example, blue pigments that may be used include Prussian blue, phthalocyanine blue and cobalt blue. Yellow pigments that may be used include chrome yellow, zinc yellow, cadmium yellow, yellow iron oxide and nickel titanium yellow.

Next, in the practice of the invention, the cover enclosing the core is made of one or more layers. A thermoplastic resin or a thermoset resin may be used as the base material of each layer of the cover. The use of a thermoplastic resin or a thermoplastic elastomer is especially preferred. Exemplary thermoplastic resins include ionomer resins. Commercial products that may be used include Himilan (ionomer resins produced by DuPont-Mitsui Polychemicals Co., Ltd.), Surlyn (ionomer resins produced by E.I. du Pont de Nemours and Co.) and Iotek (ionomer resins produced by Exxon Corporation). Exemplary thermoplastic elastomers include polyester, polyamide, polyurethane, olefin and styrene elastomers. Commercial thermoplastic elastomers that may be used include Hytrel (DuPont-Toray Co., Ltd.), Perprene (Toyobo Co., Ltd.), Pebax (Toray Industries, Inc.), Pandex (Dainippon Ink & Chemicals, Inc.), Santoprene (Monsanto Chemical Co.), Tuftec (Asahi Kasei Kogyo Co., Ltd.) and Dynaron (JSR Corporation). It is preferable for the thermoplastic resin or thermoplastic elastomer to be an ionomer resin or a thermoplastic polyurethane elastomer.

In the present invention, to fully achieve the intended effects of the invention, it is desirable for the outermost layer to be composed of a clear resin. Exemplary resins that may be used as the base resin for this purpose include the above-mentioned ionomer resins, polyurethane elastomers, polyester elastomers, polyamide elastomers and polyolefin elastomers. Various elastomers and additives may be added to the clear resin, provided the clarity is not thereby compromised.

Together with the above-described thermoplastic resin or thermoset resin serving as the base resin, the outermost cover layer in the invention also contains an inorganic composite material prepared by coating glass flakes with a metal or metal oxide. The reason for using such an inorganic composite material is that the inorganic composite material has an aspect ratio of about 10 to 20, which is substantially smaller than the aspect ratio of about 50 in aluminum pigments and pearlescent pigments. As a result, weld lines do not readily appear following injection molding. Therefore, three-dimensionally distributing this material throughout a cover layer of the prescribed thickness strengths the visual impact of the ball's appearance and makes it possible to provide a uniform aesthetic appearance regardless of the direction from which the ball is seen. Glass flakes coated with a metal or metal oxide may be used as the inorganic composite material.

Exemplary metals for this purpose include gold, silver and nickel. Use can be made of inorganic composite materials prepared by coating these metals onto glass flakes (matrix) by an electroless plating process.

The metal oxides are exemplified by titanium dioxide. Use can be made of inorganic composite materials prepared by directly coating these metal oxides onto glass flakes (matrix), in which case it is desirable to use a film-forming method that is a liquid phase process. For safety reasons, the use of rutile titanium dioxide having a low photocatalytic activity is preferred.

When glass flakes coated with titanium dioxide are used as the inorganic composite material, the interference color varies depending on the thickness of the titanium dioxide coat, enabling silver, yellow, red, blue, green and other colors to be achieved. As the thickness of the titanium dioxide coat increases, the color perceived approaches green coloration in the following order: silver-yellow-red-blue-green.

Because the glass flakes are clear and colorless and have a very smooth-surfaced appearance, unlike natural mica, they do not have cracks and each flake retains its shape. It is preferable for the above glass flakes, which are in the form of a flake-like glass powder, to have an average thickness of 20 μm or less and an average length of 10 to 4,000 μm.

The above-described inorganic composite material has the following chemical and mechanical characteristics.

(i) Flat, uniform metal surfaces, which enable intense brightness to be achieved.

(ii) Random orientation, providing brightness over a broad viewing range.

(iii) The specific gravity is close to that of glass and lighter than that of metal foil or metal powder. Hence, dispersibility is good and the resulting composition is easy to work.

(iv) The matrix can be protected by the barrier effects of the metal film, effectively preventing the warping and shrinkage of resin moldings.

To fully manifest the effects of the invention, it is desirable for the above inorganic composite material to be included in an amount of 0.01 to 5 parts by weight, and especially 0.1 to 1 part by weight, per 100 parts by weight of the base resin.

Titanium oxide may be included in the above outermost cover layer, provided the titanium oxide is included in a very small amount that does not compromise the transparency or translucency of the outermost cover layer. Typical titanium oxides are rutile (high-temperature) and anatase (low-temperature), either of which may be used. These may be manufactured by a suitable process such as the sulfate process or the chloride process, and may be surface treated with hydrous oxides of aluminum and silicon. Use can also be made of, for example, ultrafine titanium oxide particles (particle diameter, 0.02 to 0.05 μm), high-purity titanium oxide, or titanium oxide needles (fiber diameter, 0.05 to 0.15 μm; fiber length, 3 to 12 μm).

The hardness of the above cover layer is not subject to any particular limitation, although it is recommended that the Shore D hardness be preferably at least 40, more preferably at least 45, even more preferably at least 50, and most preferably at least 55, but preferably not more than 70, more preferably not more than 65, and even more preferably not more than 60. If the cover hardness is too high, the ball may have a poor durability to repeated impact and too hard a feel when hit. On the other hand, if the cover hardness is too low, the rebound may decrease and the spin rate may rise, resulting in shorter distance of travel.

Various additives, such as UV absorbers, antioxidants, metal soaps, pigments other than the above and inorganic fillers, may be added in appropriate amounts to the base resin of the above cover layer, provided the objects of the invention can be attained.

The thickness of the cover layer or layers (i.e., the thickness per layer of the cover) is not subject to any particular limitation, although it is desirable for the cover layer or layers to be formed to a thickness of preferably at least 1.0 mm, more preferably at least 1.5 mm, and even more preferably at least 2.0 mm, but preferably not more than 2.5 mm, more preferably not more than 2.2 mm, and even more preferably not more than 2.1 mm. If the respective cover layers are too thin, the ball may have a poor durability to cracking under repeated impact. On the other hand, if the respective cover layers are too thick, the transparency of the cover layer itself may decrease, lowering the brightness of the ball.

A known method such as injection molding or compression molding may be used to form the cover layer over the core and thereby obtain the inventive golf ball. For example, if injection molding is carried out, production may involve setting a prefabricated core within the injection mold, then following a conventional procedure to introduce the cover-forming material into the mold. A three-piece solid golf ball composed of a core and two cover layers may similarly be produced by carrying out the foregoing injection molding method two times—once for each of the cover layers. To form numerous dimples on the surface of the outermost of the cover layers, it is generally desirable to use a golf ball mold with a cavity in which numerous dimple-forming projections have been formed.

In the practice of the invention, the molded golf ball may then be subjected to other operations, such as trimming and painting, according to methods commonly known and used in the art so as to give the finished product.

In the inventive golf ball formed as described above, it is recommended that the ball itself have a deflection (deformation), when subjected to a load of 1275 N (130 kgf) from an initial load of 98 N (10 kgf), of generally at least 2.3 mm, preferably at least 2.8 mm, and more preferably at least 3.2 mm, but not more than 5.0 mm, preferably not more than 4.0 mm, and more preferably not more than 3.7 mm. A ball with a smaller than desirable deflection may have a harder feel when hit and may have a period of contact between the ball and the club at the time of impact which is so short as to result in a poor controllability. On the other hand, a ball with a larger than desirable deflection may have too soft a feel when hit and may have a poor durability to cracking on repeated impact.

The inventive golf ball has an initial velocity of generally at least 76.5 m/s, preferably at least 76.8 m/s, and more preferably at least 77.2 m/s, but not more than 77.724 m/s. If the initial velocity is too low, the ball may not travel far enough. On the other hand, an initial velocity greater than 77.724 m/s will disqualify the ball under the standards established by the R&A (USGA), and render the ball ineligible for registration as an officially approved ball.

The golf ball of the invention may be produced in accordance with the Rules of Golf for use in competitive play. That is, the ball may be manufactured to a diameter of not less than 42.67 mm and a weight of not more than 45.93 g. The upper limit in the diameter of the ball is preferably not more than 44.0 mm, more preferably not more than 43.5 mm, and most preferably not more than 43.0 mm. The lower limit in the weight is preferably at least 44.5 g, more preferably at least 45.0 g, even more preferably at least 45.1 g, and most preferably at least 45.2 g.

As described above, by including a special inorganic composite material in the outermost cover layer, the golf ball of the invention can be conferred with aesthetic characteristics which are novel and have an impact on the appearance of the ball, making the ball highly fashionable. Including the inorganic compound material in the cover layer also enables an excellent scuffing resistance to be achieved.

EXAMPLES

The following Examples of the invention and Comparative Examples are provided by way of illustration and not by way of limitation.

Examples 1 to 4, Comparative Example 1

The same solid cores were used in all the examples of the invention and in the comparative example. These solid cores were produced by using the rubber composition shown below and vulcanizing at 155° C. for 15 minutes. The cores were all blue in color.

| Core-Forming Composition | |
|---|---|
| Polybutadiene | 100 parts by weight |
| Zinc acrylate | 19.5 parts by weight |
| Organic peroxide (1) | 0.6 part by weight |
| Organic peroxide (2) | 0.6 part by weight |
| Antioxidant | 0.1 part by weight |
| Zinc oxide | 27.2 parts by weight |
| Organosulfur compound | 0.1 part by weight |
| Blue pigment | 0.1 part by weight |

Details of the above ingredients of the solid core are provided below.

Polybutadiene: Produced by JSR Corporation under the trade name BR01.

Organic peroxide (1): Dicumyl peroxide, produced by NOF Corporation under the trade name Percumyl D.

Organic peroxide (2): 1,1-Bis(t-butylperoxy)-3,3,3-trimethylcyclohexane, produced by NOF Corporation under the trade name Perhexa 3M-40.

Antioxidant: 2,2-Methylenebis(4-methyl-6-tert-butylphenol), produced by Ouchi Shinko Chemical Industry Co., Ltd. under the trade name Nocrac NS-6.

Organosulfur compound: Zinc salt of pentachlorothiophenol.

Blue pigment: Produced by Resino Color Industry Co., Ltd. under the trade name Resino Blue RT-K.

Next, cover ingredients in the proportions shown in Table 1 below were mixed at about 200° C. in a kneading-type twin-screw extruder, giving a pelletized cover-forming material, which was then injected into a mold in which the above-described cover material-enclosed solid core had been placed, thereby producing a two-piece solid golf ball.

TABLE 1

| | Example 1 | Example 2 | Example 3 | Example 4 | Comparative Example 1 |
|---|---|---|---|---|---|
| Cover | | | | | |
| Himilan 1557 | 50 | 50 | 50 | 50 | 50 |
| Himilan 1601 | 50 | 50 | 50 | 50 | 50 |
| Cover color | | | | | |
| Inorganic composite material (blue) | 0.5 | | | 0.5 | |
| Inorganic composite material (silver colored) | | 0.5 | | | |
| Inorganic composite material (red) | | | 0.5 | | |
| Titanium oxide | 0 | 0 | 0 | 0.1 | |
| Sheet hardness (Shore D) | 60 | 60 | 60 | 60 | 60 |
| Gauge (mm) | 2.1 | 2.1 | 2.1 | 2.1 | 2.1 |

Note: Numbers in the table indicate parts by weight

Trade names and other details of the above cover ingredients above are given below.

Himilan 1557, Himilan 1601: Ionomer resins produced by DuPont-Mitsui Polychemicals Co., Ltd.

Inorganic composite material (blue): Metashine R, produced by Nippon Sheet Glass Co., Ltd. A luster pigment prepared by coating glass flakes as the matrix with rutile titanium dioxide. Basic product number: MC5090RQ.

Inorganic composite material (silver colored): Aside from being electroless plated with silver, this is a luster pigment identical to the above inorganic composite material (blue). Basic product number: MC5150PS.

Inorganic composite material (red): Aside from having a different rutile titanium dioxide coat thickness, this is a luster pigment identical to the above inorganic composite material (blue). Basic product number: MC5090RR.

TABLE 2

| | Example 1 | Example 2 | Example 3 | Example 4 | Comparative Example 1 |
|---|---|---|---|---|---|
| Core properties | | | | | |
| Diameter (mm) | 38.55 | 38.55 | 38.55 | 38.55 | 38.55 |
| Weight (g) | 35.5 | 35.5 | 35.5 | 35.5 | 35.5 |
| Deflection (10-130 kgf) (mm) | 4.5 | 4.5 | 4.5 | 4.5 | 4.5 |
| Shore D hardness at core surface | 41 | 41 | 41 | 41 | 41 |
| Shore D hardness at core center | 34 | 34 | 34 | 34 | 34 |
| Ball | | | | | |
| Diameter (mm) | 42.7 | 42.7 | 42.7 | 42.7 | 42.7 |
| Weight (g) | 45.4 | 45.4 | 45.4 | 45.4 | 45.6 |
| Deflection (10-130 kgf) (mm) | 3.6 | 3.6 | 3.6 | 3.6 | 3.6 |
| Initial velocity (m/s) | 77.3 | 77.3 | 77.3 | 77.3 | 77.3 |
| Flight performance | good | good | good | good | good |
| Feel | good | good | good | good | good |

Ball Deflection and Solid Core Deflection

The compressive deformation (mm) of each of the resulting golf balls and solid cores when subjected to loading from an initial load of 10 kgf (98.07 N) to a final load of 130 kgf (1274.91 N) was measured.

Hardness at Surface and Center of Solid Core

The core was temperature conditioned to 23° C., then both hardnesses were measured in terms of the Shore D hardness (using a type D durometer in accordance with ASTM-2240). The surface hardnesses shown in the table were obtained by measuring the hardness at each of two randomly chosen points on the surface of the core, and determining the average of the measured values. The center hardnesses shown in the table were obtained by cutting the solid core into two halves with a fine cutter, measuring the hardness at the center of the sectioned plane on each of the two hemispheres, and determining the average of the measured values.

Shore D Hardness of Cover

The cover material was formed into a 1 mm thick sheet, and the Shore D hardness was measured according to ASTM D-2240.

Initial Velocity

The initial velocity (m/s) was measured using an initial velocity measuring apparatus of the same type as the USGA drum rotation-type initial velocity instrument approved by the R&A. The ball was temperature conditioned in a 23±1° C. environment for at least 3 hours, then tested in a chamber at a room temperature of 23±2° C. The ball was hit using a 250-pound (113.4 kg) head (striking mass) at an impact velocity of 143.8 ft/s (43.83 m/s). One dozen balls were each hit four times. The time taken to traverse a distance of 6.28 ft (1.91 m) was measured and used to compute the initial velocity (m/s) of the ball. This cycle was carried out over a period of about 15 minutes.

Flight Performance

The total distance traveled by the ball when hit at a head speed of 35 m/s with a No. 1 wood mounted on a golf swing robot was measured. The No. 1 wood was the Tour Stage V36 (loft angle, 10.50; shaft flex, R) manufactured by Bridgestone Sports Co., Ltd. The distance was rated as follows.

Good: Total distance was 165.0 m or more

NG: Total distance was less than 165.0 m

Feel

The feel of the ball when hit with a No. 1 wood was sensory evaluated by ten amateur women golfers having head speeds of 35 to 40 m/s, and rated according to the following criteria.

Good: Seven or more of the ten golfers thought the feel was good.

Fair: Four to six of the ten golfers thought the feel was good.

NG: Three or fewer of the ten golfers thought the feel was good.

Ball Appearance

The two-piece solid golf balls obtained in Examples 1 to 4 and Comparative Example 1 were visually examined to assess their appearance. As a result, the golf balls in Examples 1 to 4 were all found to have an aesthetic appearance that made an impact and left an impression of fashionability. By contrast, in Comparative Example 1, because the special inorganic composite material had not been added to the cover material, the golf ball had an aesthetic appearance inferior to that of the inventive golf balls and lacked fashionability.

The invention claimed is:

1. A golf ball comprising a core or a sphere composed of a core enclosed by a cover layer, and an outermost cover layer which covers a surface of the core or a surface of the sphere, wherein the outermost cover layer is composed primarily of at least one thermoplastic resin or thermoset resin, which resin contains an inorganic composite material prepared by coating glass flakes with a metal or metal oxide;

wherein the inorganic composite material has an aspect ratio of about 10 to 20;

the metal or metal oxide is selected from a group consisting of gold, silver, nickel and titanium dioxide; and the outermost cover layer has a Shore D hardness of at least 45 but not more than 60.

2. The golf ball of claim 1, wherein the inorganic composite material is included in an amount of 0.01 to 5 parts by weight per 100 parts by weight of the resin.

3. The golf ball of claim 1, wherein the outermost cover layer is clear or translucent.

4. The golf ball of claim 1, wherein the outermost cover layer has a thickness of at least 1.0 mm but not more than 2.5 mm.

5. The golf ball of claim 1, wherein the core has a deflection, when subjected to a load of 1275 N (130 kgf) from an initial load of 98 N (10 kgf), of from 2.5 to 6.0 mm.

6. The golf ball of claim 1, wherein the surface of the core, or the surface of the sphere composed of a core enclosed by a cover layer, is colored.

7. The golf ball of claim 1, wherein the metal or metal oxide is rutile titanium dioxide.

8. The golf ball of claim 1, wherein titanium oxide is included in the outermost cover layer.

* * * * *